US006128991A

United States Patent [19]

Nakagawa et al.

[11] Patent Number: 6,128,991

[45] Date of Patent: Oct. 10, 2000

[54] PUNCH AND DIE DEVICE FOR WORKING PIPE

[75] Inventors: Hiroshi Nakagawa; Yutaka Momota, both of Okazaki, Japan

[73] Assignee: Nisshinbo Industries, Inc., Tokyo, Japan

[21] Appl. No.: 09/145,183

[22] Filed: Sep. 1, 1998

[30] Foreign Application Priority Data

Sep. 9, 1997 [JP] Japan ..... 9-259414
Jun. 23, 1998 [JP] Japan ..... 10-190970

[51] Int. Cl.[7] ..... B23D 21/14

[52] U.S. Cl. ..... 83/181; 83/193; 83/178; 83/179; 83/686; 83/689

[58] Field of Search ..... 83/181, 193, 178, 83/179, 184, 54, 451, 685, 686–689

[56] References Cited

U.S. PATENT DOCUMENTS

| | | | |
|---|---|---|---|
| 2,526,336 | 10/1950 | Diekmann et al. | 164/47 |
| 2,670,795 | 3/1954 | Griep | 83/181 |
| 2,829,983 | 4/1958 | De Gain | 83/181 |
| 3,259,003 | 7/1966 | Griffin | 83/54 |
| 3,266,356 | 8/1966 | Seravin et al. | 83/181 |
| 4,082,022 | 4/1978 | Horn et al. | 83/181 |
| 4,440,052 | 4/1984 | Weisbeck | 83/140 |
| 4,470,330 | 9/1984 | Lindell | 83/82 |
| 5,896,796 | 4/1999 | Chih | 83/181 |

FOREIGN PATENT DOCUMENTS

| | | | |
|---|---|---|---|
| 2497699 | 7/1982 | France | 83/181 |

*Primary Examiner*—Jessica J. Harrison
*Assistant Examiner*—Minh Trinh
*Attorney, Agent, or Firm*—Rogers & Killeen

[57] ABSTRACT

A punch and die device for working such as punching of a pipe material is disclosed, of which internal die means can easily be inserted into a pipe material even if an open end of the pipe material to be worked has burrs inward extending therefrom, and in which it is easily detected whether the internal die means is pushed toward a lateral side or lateral sides of the pipe material and thereby firmly held. The punch and die device for working a pipe material comprises: external punch means located outside a pipe material P, and internal die means K inserted in the pipe material for cooperation with a punch 30 of the external punch means to work the pipe material P; the internal die means K being divided into two parts in a direction orthogonal to that of reciprocating motion of the punch 30 of the external punch means, one 1 of the parts having working function and the other 2 having no working function, the non-working part 2 being forward and backward movable in the opening direction, i. e., longitudinal direction of the pipe material P; the internal die means being provided with mechanisms each for converting the forward or backward movement of the non-working part 2 into a force pushing the working part 1 of the internal die means K toward a side p2 lateral to a side p1 to be worked of the pipe material P and for exerting the force on the working part 1 to thereby firmly hold the internal die means K pressed against the pipe material. A punch and die device for working such as punching of a pipe material is also disclosed, which is capable of working any pipe material at a position on the center line of the pipe material with respect to the width direction even if there are variations in pipe width.

7 Claims, 9 Drawing Sheets

PUNCH AND DIE DEVICE FOR WORKING PIPE

BACKGROUND OF THE INVENTION

1. Field of the Invention

The present invention relates to a punch and die device for working a pipe material. In particular, it relates to a punch and die device comprising improved inner die means which is inserted and placed in a pipe in working operation.

2. Description of the Prior Art

As heretofore, in working of a pipe material such as punching, working is performed by cooperation between external punch means located outside the pipe material and internal die means inserted and placed in the pipe material.

Conventional internal die means inserted and placed in a pipe material P include one which comprises, as shown in FIG. 11, mechanisms for pushing one p2 of sides lateral relative to a side p1 to be worked of the pipe P by means of balls 64 biased with forces of springs 63 to thereby position the internal die means with a punch 30 of upper or external punch means and a die D of the lower or internal die means in alignment with each other. In FIG. 11, reference number 61 is an upper block of the internal die means and reference number 62 is a lower block of the same.

However, such conventional internal die means has a problem as follows. To be capable of pushing the one p2 of the sides of the pipe material P which are lateral relative to the side p1 to be worked by means of the balls 64 biased with the forces of the springs 63, the internal die means to be inserted necessarily has an outer dimension which is larger as compared with the inner dimension of the pipe material P between the side p2, on which the balls 64 abut, and the side p3 opposite thereto. Accordingly, it is not easy to insert the internal die means into the pipe material P from an open end of the pipe material P, and a strong force is required for the insertion. In particular, if the open end has burrs inward extending therefrom, the insertion becomes further difficult.

The conventional device has another problem as follows. The positioning of the internal die means is performed under the forces of the springs 63 and the actions of the balls 64, as described above. Accordingly, if any operational failure is caused in the balls 64, it is difficult to detect the condition. Further, the positional relationship between the working portion (die) of the internal die means inserted in the pipe material P and the pipe material P is determined according to the distance from the one side of the inner surface of the pipe material P to the working portion (die). Accordingly, in a case where it is required to work a pipe material P at a position on the center line of the pipe material P with respect to the width direction, if there are variations in widths of pipes P, it is not possible to effect working which satisfies the requirement with respect to every pipe P.

SUMMARY OF THE INVENTION

In view of the above problems of the conventional technique, it is an object of the present invention to provide a punch and die device for working such as punching of a pipe material, of which internal die means can easily be inserted into a pipe material even if an open end of the pipe material to be worked has burrs inward extending therefrom, and in which it is easily detected whether the internal die means is pushed toward a lateral side or lateral sides of the pipe material and thereby firmly held. It is another object of the present invention to provide a punch and die device for working such as punching of a pipe material, which is capable of working any pipe material at a position on the center line of the pipe material with respect to the width direction even if there are variations in pipe width.

The present invention has been made with a view to attaining the above object.

According to one aspect of the present invention, there is provided a punch and die device for working a pipe material, the device comprising:

external punch means located outside a pipe material, and internal die means inserted in the pipe material for cooperation with a punch of the external punch means to work the pipe material;

the internal die means being divided into two parts in a direction orthogonal to that of reciprocating motion of the punch of the external punch means, one of the parts having working function and the other having no working function, the non-working part being forward and backward movable in the opening direction, i. e., longitudinal direction of the pipe material, the internal die means being provided with mechanisms each for converting the forward or backward movement of the non-working part into a force pushing the working part of the internal die means toward a side lateral to a side to be worked of the pipe material and for exerting the force on the working part to thereby firmly hold the internal die means pressed against the pipe material.

In this aspect of the present invention, the internal die means may be provided with mechanisms each for converting the forward or backward movement of the non-working part into a pair of forces pushing the working part of the internal die means respectively toward a side lateral to the side to be worked of the pipe material and toward a side opposite to the lateral side and for concurrently exerting the forces on the non-working part to thereby position and firmly hold the internal die means always on the center line with respect to an inner width of the pipe material.

According to another aspect of the present invention, there is provided a punch and die device for working a pipe material, the device comprising:

external punch means located outside a pipe material, and internal die means inserted in the pipe material for cooperation with a punch of the external punch means to work the pipe material;

the internal die means being divided into at least three parts in a direction orthogonal to that of reciprocating motion of the punch of the external punch means, one of the parts having working function and the others having no working function, at least one of the non-working parts being forward and backward movable in the opening direction, i. e., longitudinal direction of the pipe material to thereby provide the internal die means with a mechanism for expansion/contraction of the internal die means between a side to be worked and a side opposite thereto, the internal die means being provided, in regard to each forward and backward movable part, with mechanisms each for converting the forward or backward movement the movable part into a force pushing the working part of the internal die means toward a side lateral to the side to be worked of the pipe material and for exerting the force on the working part to thereby firmly hold the internal die means pressed against the pipe material.

In this aspect of the present invention, the internal die means may be provided, in regard to each forward and backward movable part, with mechanisms each for converting the forward or backward movement of the movable part into a pair of forces pushing the working part of the internal die means respectively toward a side lateral to the side to be worked of the pipe material and toward a side opposite to the lateral side and for concurrently exerting the forces on the working part to thereby position and firmly hold the working part of the internal die means always on the center line with respect to an inner width of the pipe material.

Further, in these aspects of the present invention, it is preferred that the force pushing the internal die means toward the side lateral to the side to be worked of the pipe material and, if generated, the force pushing the internal die means toward the side opposite to the lateral side be exerted on the internal die means by the agency, respectively, of one end and the other end of a lever mounted on the working part of the internal die means and connected to the movable part.

It is preferred that the one or each of the ends of the lever be provided with a rolling member in the form of a roller, ball or the like, or a sliding member. By virtue of this, smooth operation is obtained.

It is preferred that the forward or backward movement of the movable part be converted, via an elastic member in the form of a spring or the like, into the force pushing toward the side lateral to the side to be worked of the pipe material or into the pair of the forces pushing respectively toward the lateral side and toward the side opposite thereto.

DESCRIPTION OF THE PREFERRED EMBODIMENTS

Now, embodiments of the present invention will be described with reference to the drawings.

Figure 1:
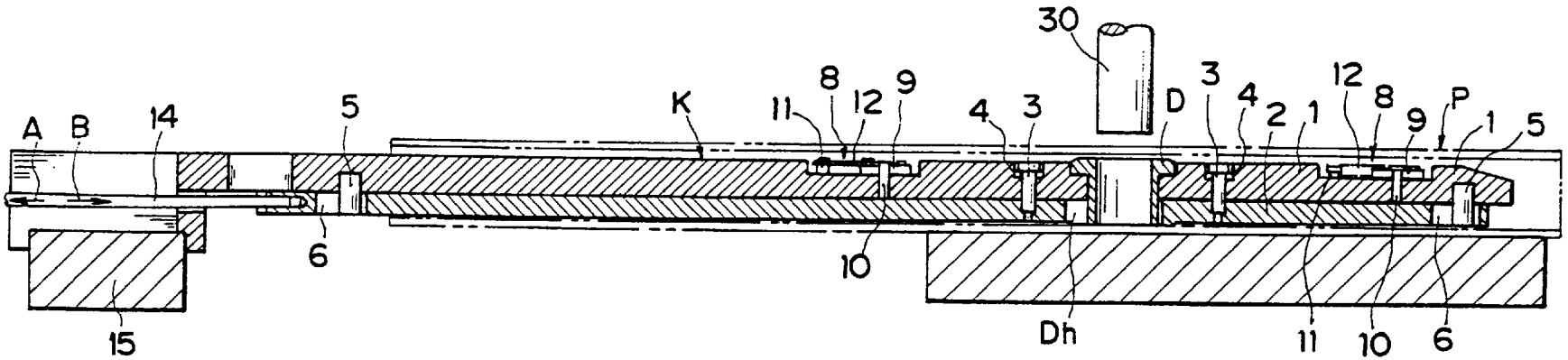
FIG. 1 is a longitudinal sectional front view of one embodiment of the device of the present invention with one form of the internal die means inserted in a pipe material to be worked.
Figure 2:
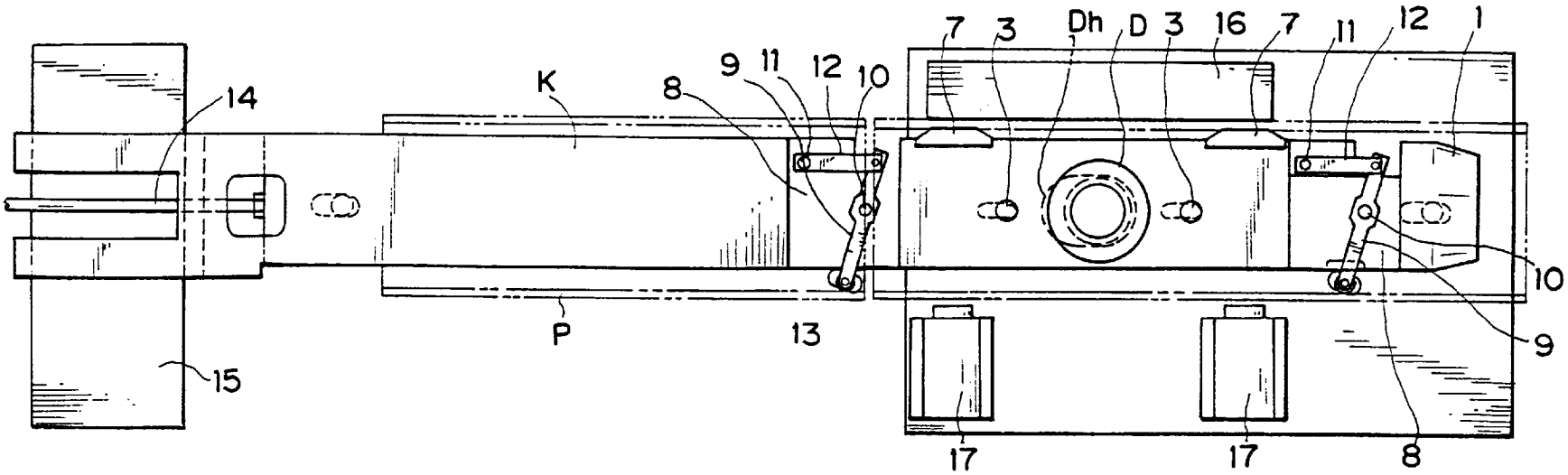
FIG. 2 is a plan view of the device in FIG. 1.
Figure 3:
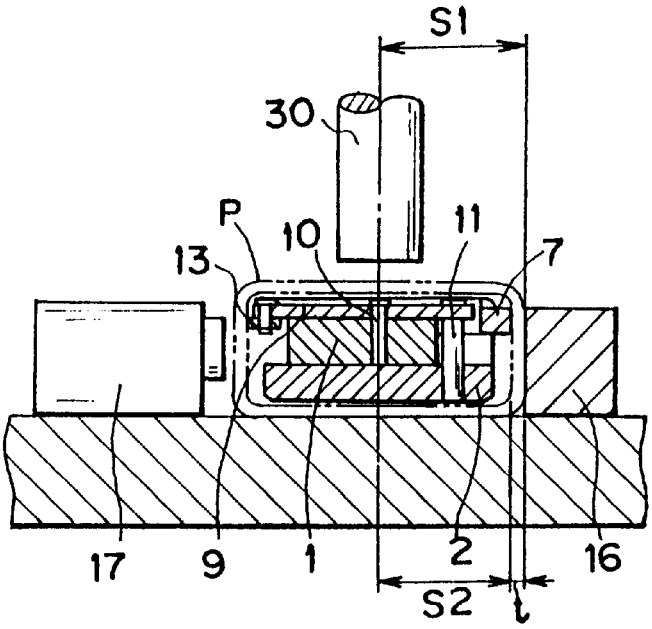
FIG. 3 is a cross-sectional side view of the device in FIG. 1, which is viewed from the right.

In FIGS. 1 to 3, one form of the inner die means of the present invention is shown, which is constructed as follows. Reference number 1 represents an upper block as one divisional part of inner die means, which is provided with a dye D fixedly attached thereto. Reference number 2 represents a lower block as the other divisional part of the inner die means, which is placed in contact with a lower portion of an inner surface of a pipe P. Reference number 3 represents a stud pin having a head, and stud pins 3 are each inserted through a spot-faced hole of the upper block 1, and reference number 4 represents a spring washer interposed between a lower surface of the head of the stud pin 3 and a spot facing of the spot-faced hole in the upper block 1 for pressing the upper block 1 against the lower block 2 to thereby keep these upper and lower blocks 1, 2 abutting upon each other in the vertical direction. Reference number 5 represents a guide pin, and guide pins 5 are mounted on the upper block 1 in longitudinally opposite end portions and downward extend from a lower surface of the upper block 1. The guide pins are movably fitted in oblong holes 6 formed in opposite end portions of the lower block 2, respectively. In the lower block 2, an oblong hole Dh is formed for movably fitting therein a lower portion of the die D fixedly mounted on the upper block 1. The oblong holes 6 and the oblong hole Dh are so formed that the movably fitted pins and die D are permitted to move in the same vector. Reference number 7 represents a reference block fixedly mounted to the upper block 1 of the internal die means. In the above internal die means, the upper block 1 of the internal die means divided into the two parts is the one of the divisional parts which is provided with the die D having working function (the one is hereinafter sometimes referred to as "working part"), and hence the lower block 2 is the other which has no working function (the other is hereinafter sometimes referred to as "non-working part") and which is forward and backward movable in a longitudinal direction of the pipe P.

Reference number 8 represents a mechanism mounting space, and two mechanism mounting spaces 8 are concavely provided in an upper surface of the upper block 1 with the die D therebetween. In each of the spaces 8, a turnable lever 9 is pivotally mounted on a vertical pin 10. The turnable lever 9 has its rear end (the upper end in FIG. 2) connected to one end of a tension spring 12 of which the other end is supported by a stud pin 11 vertically mounted on the lower block 2 and extending into proximity to the space 8. To the front end (the lower end in FIG. 2) of the turnable lever 9, a roller 13 is attached. As an alternative to the tension spring 12, a gas spring or a non-strechable link member may be used. As an alternative to the roller 1 3, a rollable spherical member or a well-slidable slider member may be used.

Reference number 14 represents a transfer rod joined to a rear end (the left end in FIGS. 1 and 2) of the lower block 2, which is connected to to-and-fro driving means (not shown) using a feed screw mechanism, a cylinder or the like to thereby move the lower block 2 to-and-fro along the longitudinal direction of the pipe P. The above-described members basically constitute the one form of the internal die means K in the present invention.

Both of the upper block 1 and the lower block 2 are placed on a holding base 15 of a machine body in such a manner that their ends are slidably supported in the width direction of the pipe P viewed in plan (see FIG. 2). However, the upper block 1 is unmovably supported, whereas the lower block 2 is movably supported, in the longitudinal direction of the pipe P. In FIGS. 1 to 3, reference number 16 represents a reference block as a datum provided on the base 15 of the machine body. Reference number 17 represents clamp means, and clamp means 17 are mounted on the base 15 of the machine body opposite to the reference block 16 with respect to the internal die means K. During working of the pipe P, the clamp means 17 press the pipe P against the reference block 16 to firmly hold the pipe P.

Function of the one form of the internal die means according to the present invention, which is constructed as described above, will be described as follows.

The pipe P as a material to be worked is placed on the base 15 at a predetermined position with the internal die means K contained therein. Then, the pipe P is pressed against the reference block 16 by the clamp means 17 attached to the machine body and thereby firmly held. The transfer rod 14 is moved in the direction of arrow A (see FIG. 1). By the movement, each of the turnable levers 9 is turned in the counterclockwise direction in FIG. 2 via the tension spring 12 to press the roller 13 against an inner wall of the pipe P. The internal die means K as a whole including a portion provided with the die D having working function is thereby pushed toward a side, which faces the reference blocks 7, of the inner surface of the pipe P. In consequence, the internal die means K is pressed against the inner wall of the pipe P.

Then, the clamp means 17 are actuated to thereby press a portion, which corresponds to the reference blocks 7, of an outer wall of the pipe P against the reference block 16. Consequently, as illustrated in FIG. 3, there is a difference between distance S1 from an inner surface of the reference block 16 of the machine body to a center line of a punch 30 of upper or external punch means located outside the pipe P and distance S2 from an outer surface of the reference block 7 of the internal die means K inserted in the pipe P to a center line of the die D, due to a wall thickness t of the pipe P. However, if pipes to be worked are of the same kind, the wall thickness t is constant. Accordingly, by taking into consideration addition of the wall thickness t to S2 with respect to the distance form the reference block 16, the internal die means K can firmly be held in each of the pipes P of the same thickness with the center line of the die D of the internal die means K always in alignment with the center line of the punch.

Figure 5:
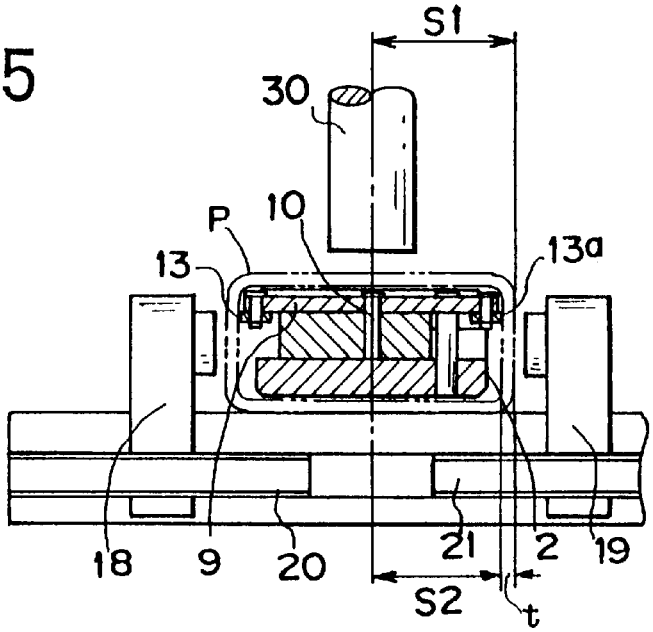
FIG. 5 is a cross-sectional side view of the device in FIG. 4, which is viewed from the right.
Figure 4:
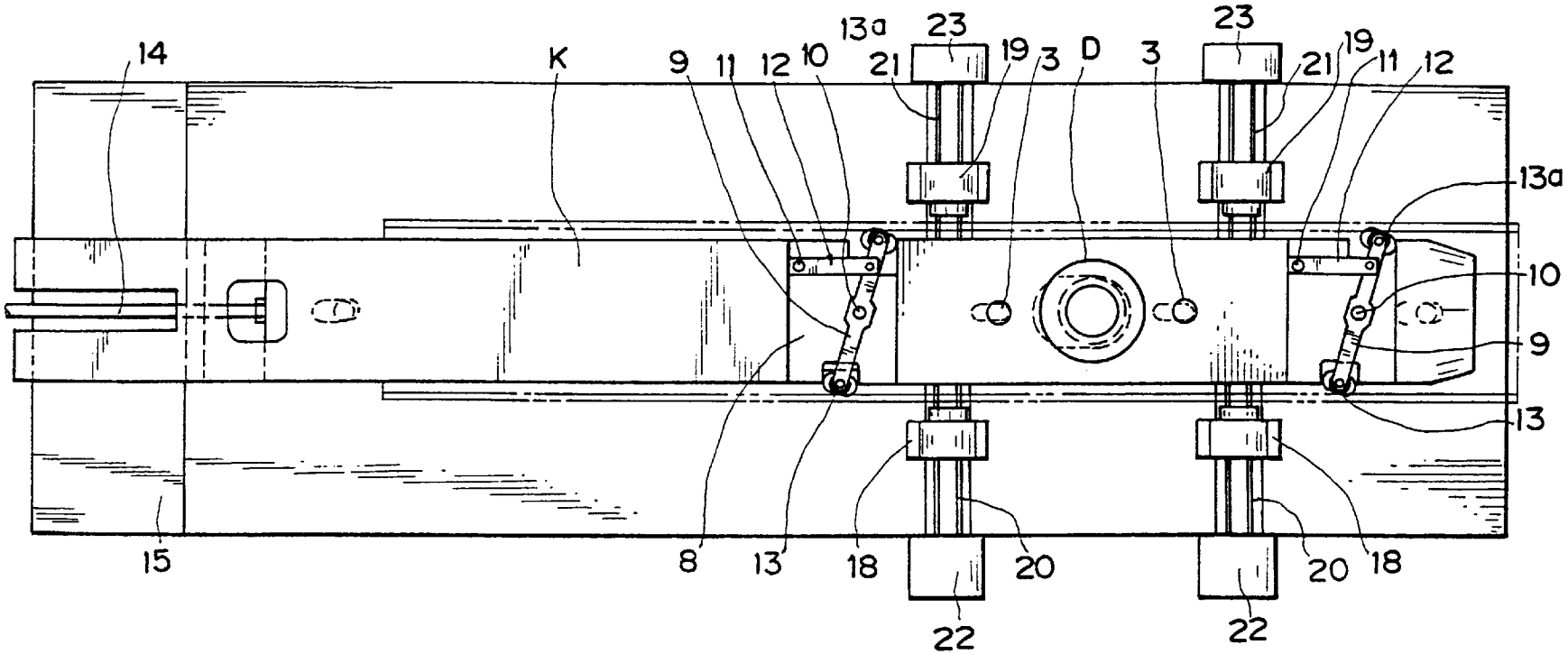
FIG. 4 is a plan view of another embodiment of the device of the present invention with another form of the internal die means inserted in a pipe material to be worked.

FIGS. 4 and 5 show another form of the internal die means according to the present invention. This form is different from the foregoing form described with reference to FIGS. 1 to 3 in that reference blocks 18 and 19 which are to-and-for movable are used instead of the reference block 16 and the clamp means 17, and that both ends of a turnable lever 9 exert pushing forces on the internal die means for pushing the internal die means toward a pipe P. In other words, in FIGS. 4 and 5, the turnable lever 9 has its both ends provided with rollers 13 equidistantly from a pin 10. The reference numbers 18 and 19 represent reference blocks, and the reference blocks 18 and the reference blocks 19 are mounted on a machine body in such a manner that the internal die means K is to be placed therebetween. Reference numbers 20 and 21 represent screws on which reference blocks 18 and 19 are screwed, respectively. Reference number 22 represents a motor for driving the screws 20 and 21, and reference number 23 represents a bearing for the screw 21. The screws 20 and 21 are reversely threaded with respect to each other. Accordingly, when the motor 22 is actuated, the reference blocks 18 and 19 move concurrently and equally toward or apart from the pipe P in the same amount. In other words, in the form shown in FIGS. 4 and 5, the pipe P is positioned on the center line of a holding base 15 of a machine body by concurrently driving the reference blocks 18 and 19 without using the clamp means 17 for pressing a pipe P against the reference block 16, and the internal die means K is positioned on the center line of the pipe P by the forces pushing the internal die means toward opposite sides of an inner wall of the pipe P by means of the rollers 13 mounted on both the ends of the turnable lever 9.

Function of the device illustrated in FIGS. 4 and 5 in punching operation to form a hole on the center line of a pipe P by means of the same will be described as follows.

The pipe P as a material to be worked is placed at on a predetermined position with the internal die tool K contained therein. Then, the motors 22 are actuated to concurrently move the reference blocks 18 and 19 equally toward the pipe P. In consequence, the pipe P is simultaneously pushed from both sides thereof and firmly held on the center line of the base 15 of the machine body. A transfer rod 14 is moved in the direction of arrow A (to the left in FIG. 4). By the movement, each of the turnable levers 9 is turned in the counterclockwise direction in FIG. 4 via a tension spring 12 to press the rollers 13 mounted on both the ends of the turnable lever 9 against both the sides of the inner wall of the pipe P. The internal die means K is thereby positioned on the center line of the pipe P and firmly held.

Figure 6:
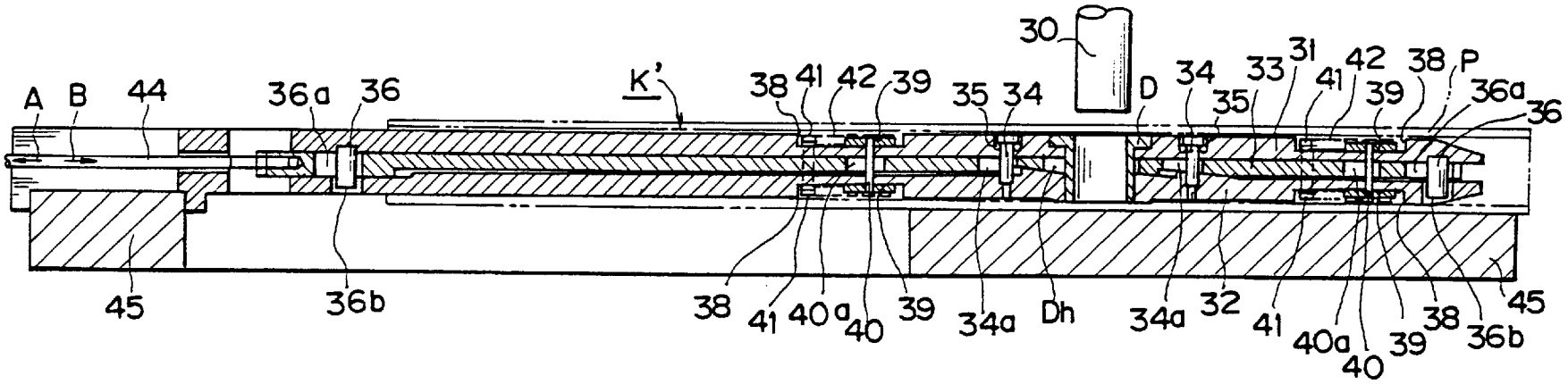
FIG. 6 is a longitudinal sectional front view of a further embodiment of the device of the present invention with a further form of the internal die means inserted in a pipe material to be worked.
Figure 7:
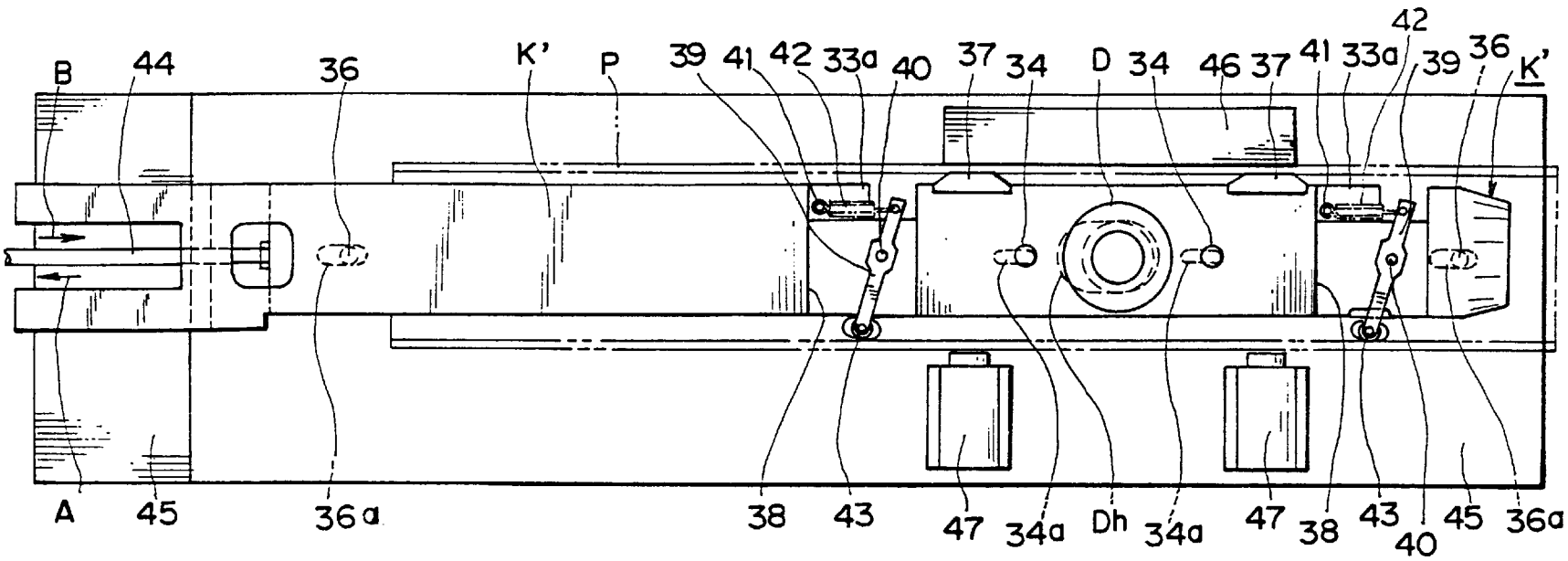
FIG. 7 is a plan view of the device in FIG. 6.
Figure 8:
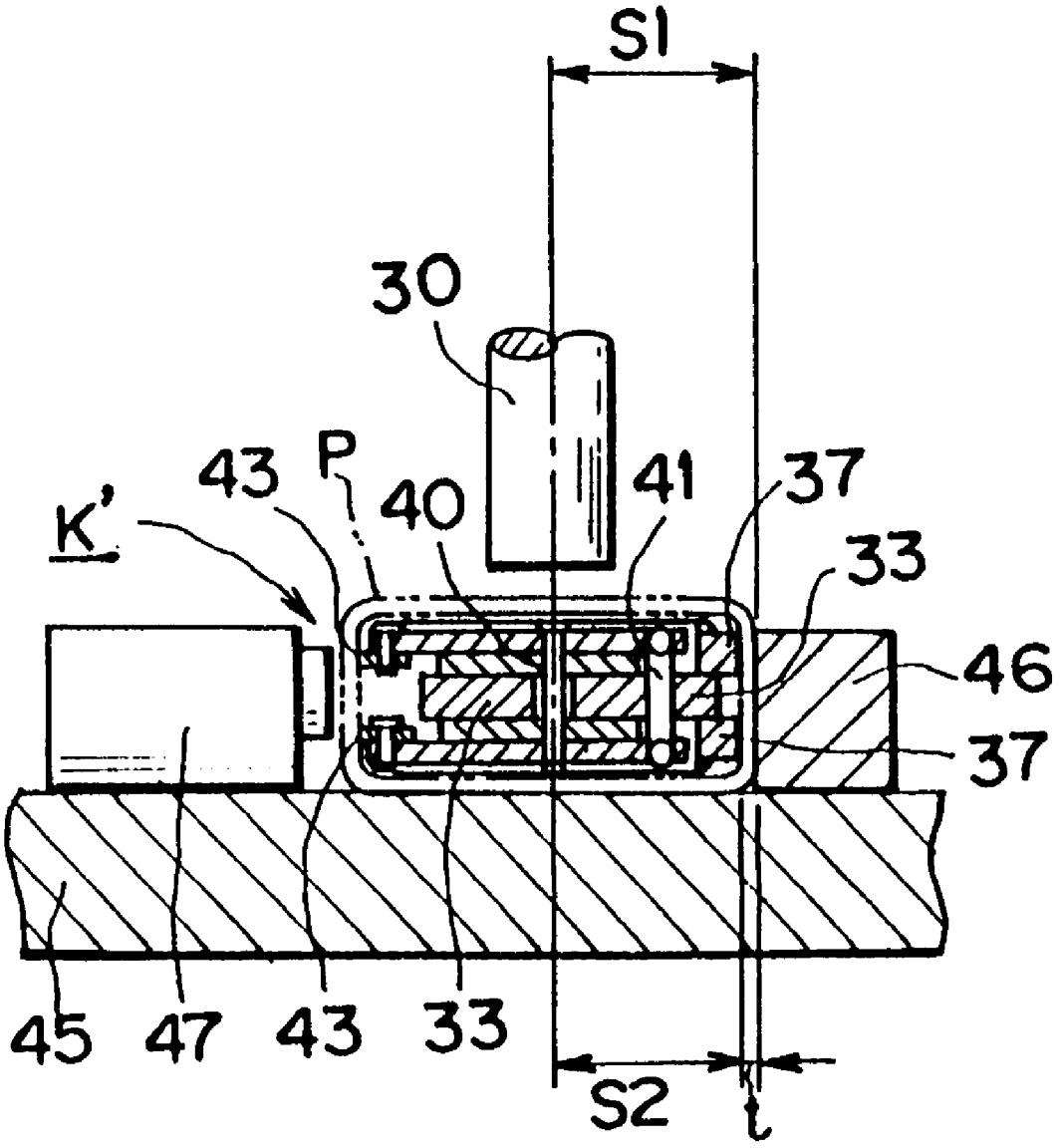
FIG. 8 is a cross-sectional side view of the device in FIG. 6, which is viewed from the right.

FIGS. 6 to 8 show a further form the internal die means of the present invention, which is designed to fit on upper and lower sides of an inner surface of a pipe to be worked. By way of an example, the internal die means is constructed as follows.

Reference number 31 represents an upper block of the internal die means, reference number 32 represents a lower block of the same whose upper surface is in part formed into a wedge-function surface (no reference number is allotted thereto), and reference number 33 represents an expansion/contraction block which is placed between the upper block 31 and lower block 32 and whose lower surface in part formed into a wedge-function surface (no reference number is allotted thereto) that is a counterpart of the wedge-function surface of the lower block 32. When the expansion/contraction block 33 is moved in the direction of arrow A (to the left in FIGS. 6 and 7), the upper block 31 is raised by cooperative action between the wedge-function surface in the lower surface of the expansion/contraction block 33 and that in the upper surface of the lower block 32 to thereby expand the internal die means in the vertical dimension. As described above, the internal die means has such a ternary structure that it is divided into three layers, i. e., the upper block 31, lower block 32 and expansion/contraction block 33. In the present invention, the internal die means K may have a structure comprising three layers or more. In particular, the internal die means K may comprise one or more expansion/contraction blocks. When the internal die means K has a structure comprising more than three layers, for example, expansion or contraction of the internal die means in the height direction of the pipe P in a larger amount can be attained with a smaller movement of an expansion/contraction block. This is because when the internal die means K comprises expansion/contraction blocks provided with wedge-function surfaces of different gradients, depending upon the gradients, different amounts of expansion or contraction of the internal die means K in the height direction thereof may advantageously be attained by the movements of the expansion/contraction blocks in the same amount.

Reference number 34 represents a stud pin, and stud pins 34 are each vertically mounted on the lower block 32 and inserted through a spot-faced hole formed in the upper block 31 and movably inserted through an oblong hole 34*a* formed in the expansion/contraction block 33. A spring 35 is interposed between a head of each of the stud pins and each of the spot facings in the upper block 32, and the upper block 31 is pushed toward the lower block 31 by the spring 35. When the expansion/contraction block 33 is moved in the direction of arrow B (to the right in FIGS. 6 and 7), the cooperative wedge action between the expansion/contraction block 33 and the lower block 32 is relaxed. In consequence, the upper block 31 is downward moved under the action of the spring 35. Reference Dh represents a through hole formed in the expansion/contraction block 33 for movably inserting a die D therethrough. The die D is fixed to the upper block 31 at its upper flange and fitted into the lower block 32 movably only in the vertical direction (see FIG. 6).

Reference number 36 represents a guide pin, and guide pins are vertically mounted on a lower surface of the upper block 31 and extending downward therefrom, and each of the guide pins 36 is movably inserted through an oblong hole 36*a* formed in the expansion/contraction block 33 and is engaged in a clearance hole 36*b* formed in the lower block 32 to thereby prevent movements of the lower block 32 and the expansion/contraction block 33 in the width direction of the pipe P relative to the upper block 31. Reference number 37 represents a reference block, and reference blocks 3 7 are fixedly attached to the upper block 31 and the lower block 32 (see FIGS. 7 and 8).

Reference number 38 represents a mechanism mounting space, and two mechanism mounting spaces 38 are concavely provided, with the die D therebetween, in each of an upper surface of the upper block 31 and a lower surface of the lower block 32. In each of the spaces 38, a turnable lever 39 is pivotally mounted on a pin 40. The turnable lever 39 has its upper end in FIG. 7 connected to one end of a tension spring 42 of which the other end is supported by a stud pin 41. To the lower end (in FIG. 7) of the turnable lever 39, a roller 43 is attached. The stud pin 41 is held by a tongue portion 33*a*, adjacent to upper and lower spaces 38, of the expansion/contraction block 33 in such a manner that it extends through the tongue portion 33*a* and protrudes therefrom upward and downward. The pin 40 extends through the upper block 31 and the lower block 32 into the upper and lower spaces 38. As an alternative to the tension spring 42, a gas spring or a non-strechable link member may be used. As an alternative to the roller 43, a rollable spherical member or a well-slidable slider member may be used.

Reference number 44 represents a transfer rod joined to a rear end (the left end in FIGS. 6 and 7) of the expansion/contraction block 33, which is connected to to-and-fro driving means (not shown) using a feed screw mechanism, a cylinder or the like to thereby move the expansion/contraction block 33 to-and-fro. The above-described members basically constitute the further form of the internal die means K' in the present invention.

Figure 9:
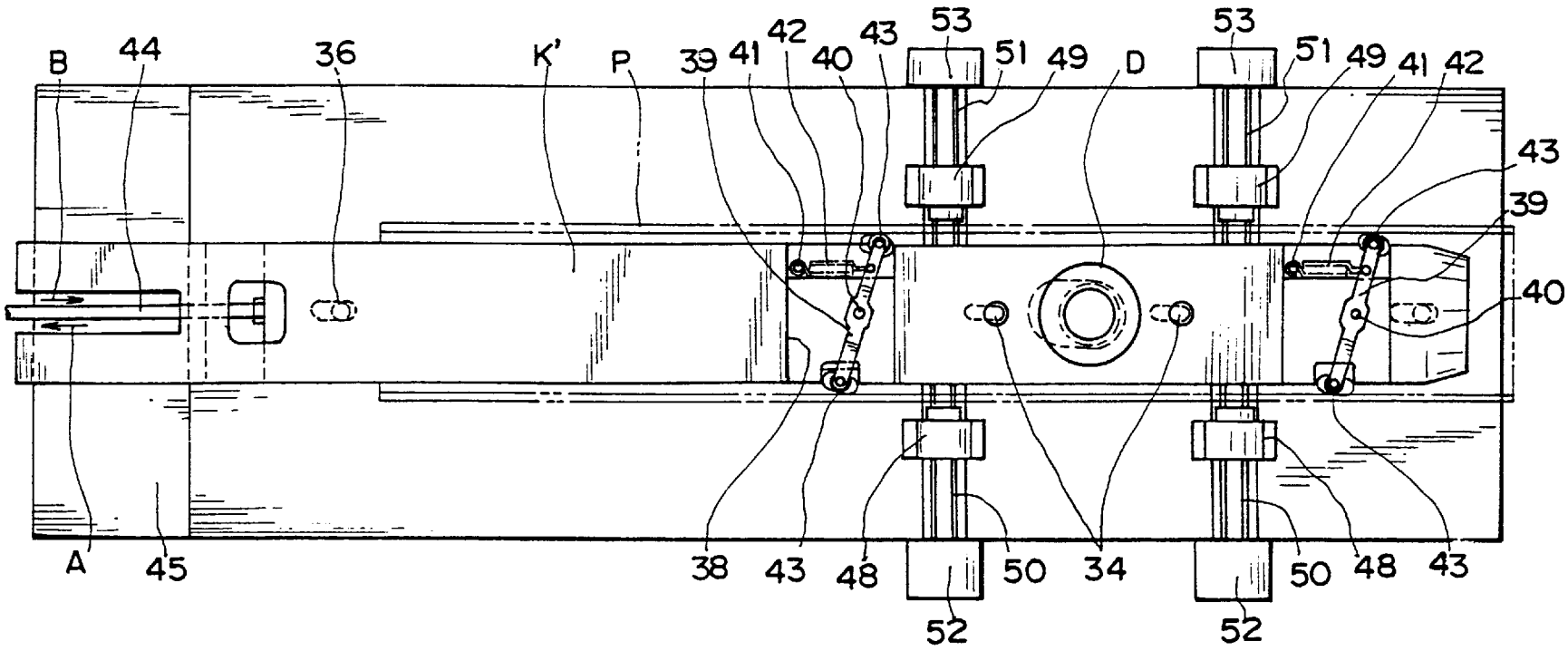
FIG. 9 is a plan view of a still further embodiment of the device of the present invention with a still further form of the internal die means inserted in a pipe material to be worked.

Both of the upper block 31 and the lower block 32 are placed on a holding base 45 of a machine body in such a manner that their ends are supported slidably in the width direction of the pipe P but unmovably in the longitudinal direction of the pipe P. In FIGS. 7 to 9, reference number 46 represents a reference block as a datum provided on the holding base 15 of the machine body. Reference number 47 represents clamp means, and clamp means 47 are mounted on the base 15 of the machine body opposite to the reference block 16 with respect to the internal die means K'. During working of the pipe P, the clamp means 47 press the pipe P against the reference block 46 to firmly hold the pipe P.

Function of the further form of the internal die means according to the present invention, which is constructed as described above, will be described as follows.

The pipe P as a material to be worked is placed on the base 45 at a predetermined position with the internal die means K' contained therein. Then, the pipe P is pressed against the reference block 46 by the clamp means 47 attached to the machine body and thereby fixedly held. Subsequently, the transfer rod 44 is moved in the direction of arrow A (see FIGS. 6 and 7). By the movement, the expansion/contraction block 33 is also moved to raise the upper block 31 under the resulting wedge-action of the expansion/contraction block 33 until an upper surface of the die D abuts on an upper side of the inner surface of the pipe P.

When the expansion/contraction block 33 is moved in the direction of arrow A, each of the stud pins 41 vertically held by the tongue portion 33*a* of the expansion/contraction block 33 is also moved in proximity to the mechanism mounting spaces 38 in the direction of arrow A. By this movement, each of the turnable levers 39 is turned in the counterclockwise direction in FIG. 7 via the tension spring 42 to press the roller 43 against the inner wall of the pipe P. The internal die means K' is thereby pressed against the inner wall of the pipe P at the reference blocks 37.

When the internal die means K' is firmly held in the pipe P in this manner, there is a difference between distance S1 from an inner surface of the reference block 46 of the machine body to a center line of a punch 30 of upper or external punch means located outside the pipe P and distance S2 from an outer surface of the reference block 37 of the internal die means K' inserted in the pipe P to a center line of the die D, due to a wall thickness t of the pipe P. However, if pipes to be worked are of the same kind, the wall thickness t is constant. Accordingly, by taking into consideration addition of the wall thickness t to S2 with respect to the distance form the reference block 46, the internal die means K' can firmly be held in each of the pipes P of the same thickness with the center line of the die D of the internal die tool K' always in alignment with the center line of the punch.

The operations of the expansion/contraction block 33 and the turnable lever 3 9 are set in such an order that prior to the abutment of the die D on the upper side of the inner wall of the pipe P under the wedge-action by the movement of the expansion/contraction block 33 in the direction of arrow A, the internal die means K' is held in position with respect to the width direction of the pipe P. Accordingly, the internal die means K' is first held in position with respect to the width direction of the pipe P by means of the tension springs 42, and it is then held in position with respect to the height direction of the pipe P by further moving the expansion/contraction block 33 until the die D abuts on the inner surface of the pipe P. From the holding of the internal die means K' in position with respect to the width direction of the pipe P to the holding thereof in position with respect to the height (vertical) direction, the momentum of the expansion/contraction block 33 is absorbed by the springs 42.

In the following, a still further form of the internal die means K' will be described with reference to FIGS. 9 and 10. This form is different from the foregoing form described with reference to FIGS. 6 to 8 in that reference block 46 is not provided, and that rollers 43 are mounted on both ends of each turnable lever 39. Each of the turnable lever 39 is pivotally mounted on a pin 40 located on center lines of upper and lower blocks 31, 32, and the rollers 43, 43 are equidistant from the pin 40.

Figure 10:
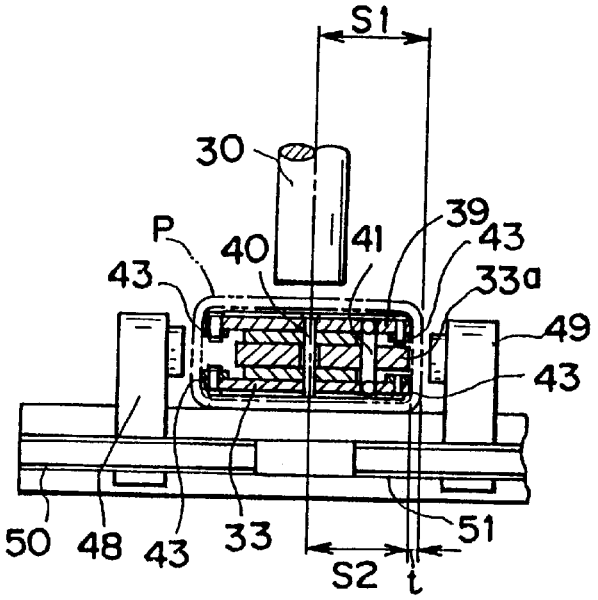
FIG. 10 is a cross-sectional side view of the device in FIG. 9, which is viewed from the right.
Figure 11:
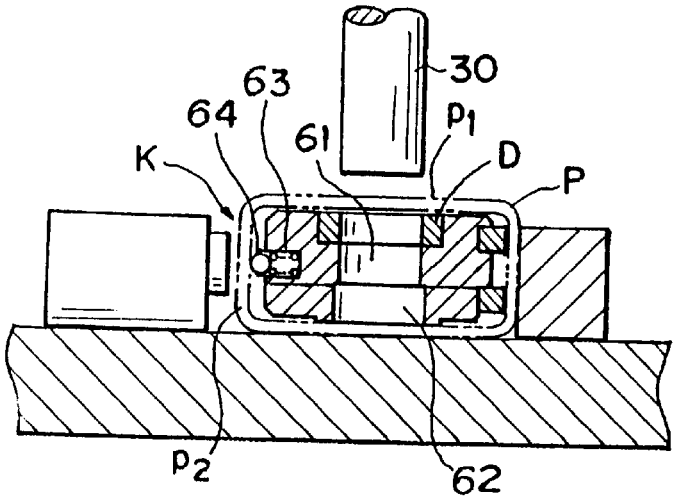
FIG. 11 is a cross-sectional side view of conventional internal die means inserted in a pipe.

In FIGS. 9 and 10, reference numbers 48 and 49 represent reference blocks, and the reference blocks 48 and the reference blocks 49 are mounted on a holding base 45 of a machine body in such a manner that internal die means K' is to be placed therebetween. Reference numbers 50 and 51 represent screws on which reference blocks 48 and 49 are screwed, respectively. Reference number 52 represents a motor for driving the screws 50 and 51, and reference number 53 represents a bearing for the screw 51. The screws 50 and 51 are reversely threaded with respect to each other. Accordingly, when the motor 52 is actuated, the reference blocks 48 and 49 move concurrently and equally toward or apart from the pipe P in the same amount.

Function of the device illustrated in FIGS. 9 and 10 in punching operation to form a hole on the center line of a pipe P by means of the same will be described as follows.

The pipe P as a material to be worked is placed at a predetermined position with the internal die means K' contained therein. Then, the motors 52 are actuated to move the reference blocks 48 and 49 equally toward the pipe P in the same amount, thereby pushing the pipe P from both sides to firmly hold the pipe P in position. A transfer rod 44 is moved in the direction of arrow A. By the movement, the expansion/contraction block 33 is also moved to raise the upper block 31 under the resulting wedge-action of the expansion/contraction block 33 until an upper surface of the die D abuts on an upper side of the inner surface of the pipe P.

In addition thereto, stud pins 41 vertically held by tongue portions 33*a* of the expansion/contraction block 33 are also moved in the direction of arrow A. By the movement, each of the turnable levers 39 is turned via a tension spring 42 to press the rollers 43 mounted on both the ends of the turnable lever 39 against both sides of the inner wall of the pipe P. The internal die means K' is thereby positioned and firmly held on the center line of the pipe P.

In the above-described manner, the pipe P is pushed by the balanced movements of the reference blocks 48 and 49 and thereby held on the holding base 45 in position, and the internal die means K' is firmly held on the center line of the pipe P irrespective of differences in wall thickness of pipes P, variations in dimension in the width direction of pipes P or the like. Accordingly, the center line of a punch 30 of external punch means located outside the pipe material P is always in alignment with the center line of the die D of the internal die means K' inserted in the pipe P irrespective of variations in wall thickness of pipes P.

The operations of expansion/contraction block 33 and the turnable lever 39 in the above described holding procedure are set in such an order that prior to the abutment of the die D on the inner wall of the pipe P under the wedge-action of the expansion/contraction block 33, the internal die means K' is held in position with respect to the width direction of the pipe P. Thereafter, the internal die means K' is held in position with respect to the height direction of the pipe P by further moving the expansion/contraction block 33 until the die D abuts on the inner surface of the pipe P. From the holding of internal die means K' in position with respect to the width direction of the pipe P to the holding thereof in position with respect to the height (vertical) direction, the momentum of the expansion/contraction block 33 is absorbed by the springs 42.

The present invention is constructed as described above. According to the first aspect thereof, the punch and die device for working a pipe material comprises:

external punch means located outside a pipe material, and internal die means inserted in the pipe material for cooperation with a punch of the external punch means to work the pipe material;

the internal die means being divided into two parts in a direction orthogonal to that of reciprocating motion of the punch of the external punch means, one of the parts having working function and the other having no working function, the non-working part being forward and backward movable in the opening direction, i. e., longitudinal direction of the pipe material, the internal die means being provided with mechanisms each for converting the forward or backward movement of the non-working part into a force pushing the working part of the internal die means toward a side lateral to a side to be worked of the pipe material and for exerting the force on the working part to thereby firmly hold the internal die means pressed against the pipe material. By virtue of this, precise working can be effected by appropriately operating the internal die means. Further, operational accuracy of the punch and die device can electrically be detected with ease.

According to the second aspect thereof, the punch and die device for working a pipe material comprises:

external punch means located outside a pipe material, and internal die means inserted in the pipe material for cooperation with a punch of said external punch means to work the pipe material;

said internal die means being divided into at least three parts in a direction orthogonal to that of reciprocating motion of the punch of said external punch means, one of said parts having working function and the others having no working function, at least one of said non-working parts being forward and backward movable in the opening direction, i. e., longitudinal direction of the pipe material to thereby provide said internal die means with a mechanism for expansion/contraction of the internal die means between a side to be worked and a side opposite thereto, said internal die means being provided, in regard to each forward and backward movable part, with mechanisms each for converting the forward or backward movement said movable part into a force pushing said working part of said internal die means toward a side lateral to the side to be worked of the pipe material and for exerting the force on said working part to thereby firmly hold said internal die means pressed against the pipe material. By virtue of this, expansion/contraction of the internal die means both in the height direction (vertical direction) and in the width direction of the internal die means can be effected from the outside of the punch and die device. Accordingly, as well as operational accuracy of the punch and die device, it can be electrically detected with ease whether or not the internal die means is appropriately expanded or contracted.

In addition, when the internal die means is inserted into a pipe material from an end opening of the pipe material, the internal die means may have a size in outside measure smaller than that of the end opening of the pipe material in inside measure by contracting the internal die means. Accordingly, the internal die means can be inserted into the pipe material with ease, even if the end opening of the pipe material has burrs inward extending therefrom.

Further, the punch and die device may comprise internal die means provided with mechanisms for positioning the internal die means on the center line of the die always on the center line with respect to an inner width of the pipe material. When this punch and die device is used in a case where it is required to work a pipe material P at a position on the center line of the pipe material P with respect to the width direction, the internal die means can precisely positioned even if there are variations in width and/or in wall thickness of pipes.

The present invention has been described in detail with reference to the specific embodiments. It is, however, to be understood that the present invention is by no means restricted thereto, and that various modification may be made without departing from scope and spirit of the present invention. For example, in the above-described embodiments, the movable part of the internal die means is moved in the direction of arrow A to firmly hold the internal die means and in the direction of arrow B to release the same. Conversely, however, the internal die means may be so constructed that the movable part thereof is moved in the direction of arrow B to firmly hold the internal die means and in the direction of arrow A to release the same.

What is claimed is:

1. A punch and die device for working a pipe material, said device comprising:

external punch means located outside a pipe material, and internal die means inserted in the pipe material for cooperation with a punch of said external punch means to work the pipe material;

said internal die means being divided into two parts in a direction along a line which is orthogonal to that of reciprocating motion of the punch of said external punch means, one of said parts having working function and the other having no working function, said non-working part being forward and backward movable in the longitudinal direction of the pipe material, said internal die means being provided with mechanisms each for converting the forward and backward movement of said non-working part into a force pushing said working part of said internal die means toward a side lateral to a side to be worked of the pipe material and for exerting the force on said working part to thereby firmly hold said internal die means pressed against the pipe material.

2. The punch and die device according to claim 1, wherein said internal die means is provided with mechanisms each for converting the forward or backward movement of said non-working part into a pair of forces pushing said working part of said internal die means respectively toward a side lateral to the side to be worked of the pipe material and toward a side opposite to the lateral side and for concurrently exerting the forces on said non-working part to thereby position and firmly hold said internal die means always on the center line with respect to an inner width of the pipe material.

3. A punch and die device for working a pipe material, said device comprising:

external punch means located outside a pipe material, and internal die means inserted in the pipe material for cooperation with a punch of said external punch means to work the pipe material;

said internal die means being divided into at least three parts in a direction along a line which is orthogonal to that of reciprocating motion of said external punch means, one of said at least three parts having working function and the others of said at least three parts having non working function, at least one of said non-working parts being forward and backward movable in the longitudinal direction of the pipe material to thereby provide said internal die means with a mechanism for expansion/contraction of the internal die means between a side to be worked and a side opposite thereto, said internal die means being provided, in regard to each forward and backward movable part, with mechanisms each for converting the forward or backward movement of said movable part into a force pushing said working part of said internal die means toward a side lateral to the side to be worked of the pipe material and for exerting the force on said working part to thereby firmly hold said internal die means pressed against the pipe material.

4. The punch and die device according to claim 3, wherein said internal die means is provided, in regard to each forward and backward movable part, with mechanisms each for converting the forward or backward movement of said movable part into a pair of forces pushing said working part of said internal die means respectively toward a side lateral to the side to be worked of the pipe material and toward a side opposite to the lateral side and for concurrently exerting the forces on said working part to thereby position and firmly hold said working part of said internal die means always on the center line with respect to an inner width of the pipe material.

5. The punch and die device according to any one of claims 1 to 4, wherein the force pushing said internal die means toward the side lateral to the side to be worked of the pipe material and, if generated, the force pushing said internal die means toward the side opposite to the lateral side are exerted on said internal die means by the agency, respectively, of one end and the other end of a lever mounted on said working part of said internal die means and connected to said movable part.

6. The punch and die device according to any one of claims 1 to 5, wherein the one or each of the ends of the lever is provided with a rolling member in the form of a roller, ball, or a sliding member.

7. The punch and die device according to any of claims 1 to 6, wherein the forward or backward movement of said movable part is converted, via an elastic member in the form of a spring, into the force pushing toward the side lateral to the side to be worked of the pipe material or into the pair of the forces pushing respectively toward the lateral side and toward the side opposite thereto.

* * * * *